US009984699B2

(12) United States Patent
Atti et al.

(10) Patent No.: US 9,984,699 B2
(45) Date of Patent: May 29, 2018

(54) HIGH-BAND SIGNAL CODING USING MISMATCHED FREQUENCY RANGES

(71) Applicant: QUALCOMM Incorporated, San Diego, CA (US)

(72) Inventors: Venkatraman S. Atti, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 194 days.

(21) Appl. No.: 14/750,784

(22) Filed: Jun. 25, 2015

(65) Prior Publication Data

US 2015/0380008 A1 Dec. 31, 2015

Related U.S. Application Data

(60) Provisional application No. 62/017,753, filed on Jun. 26, 2014.

(51) Int. Cl.

| | |
|---|---|
| ***G10L 19/26*** | (2013.01) |
| ***G10L 19/04*** | (2013.01) |
| *G10L 21/038* | (2013.01) |

(52) U.S. Cl.

CPC ..... *G10L 19/265* (2013.01); *G10L 19/04* (2013.01); *G10L 21/038* (2013.01)

(58) Field of Classification Search

CPC ..... G10L 19/08; G10L 19/24; G10L 19/265; G10L 19/04; G10L 21/038

See application file for complete search history.

(56) References Cited

U.S. PATENT DOCUMENTS

| | | | |
|---|---|---|---|
| 8,069,040 | B2 | 11/2011 | Vos et al. |
| 8,140,324 | B2 | 3/2012 | Vos et al. |
| 8,260,611 | B2 | 9/2012 | Vos et al. |
| 8,352,252 | B2 | 1/2013 | Fang et al. |
| 8,364,494 | B2 | 1/2013 | Vos et al. |
| 8,428,938 | B2 | 4/2013 | Fang et al. |
| 8,484,036 | B2 | 7/2013 | Vos et al. |
| 9,053,702 | B2 | 6/2015 | Rajendran et al. |
| 9,275,644 | B2 | 3/2016 | Rajendran et al. |

(Continued)

FOREIGN PATENT DOCUMENTS

| | | | |
|---|---|---|---|
| WO | 2006116025 | A1 | 11/2006 |
| WO | WO 2006116025 | * | 11/2006 |

(Continued)

OTHER PUBLICATIONS

International Search Report and Written Opinion—PCT/US2015/038120—ISA/EPO—dated Oct. 12, 2015, 8 pages.

*Primary Examiner* — Angela A Armstrong
(74) *Attorney, Agent, or Firm* — Toler Law Group, P.C.

(57) ABSTRACT

A method includes generating a first signal corresponding to a first component of a high-band portion of an audio signal. The first component has a first frequency range. The method includes generating a high-band excitation signal corresponding to a second component of the high-band portion of the audio signal. The second component has a second frequency range differs from the first frequency range. The high-band excitation signal is provided to a filter having filter coefficients generated based on the first signal to generate a synthesized version of the high-band portion of the audio signal.

36 Claims, 8 Drawing Sheets

(56) References Cited

U.S. PATENT DOCUMENTS

| | | | | |
|---|---|---|---|---|
| 9,384,746 | B2 | 7/2016 | Atti et al. | |
| 2008/0267224 | A1 | 10/2008 | Kapoor et al. | |
| 2011/0295598 | A1* | 12/2011 | Yang | G10L 21/038 704/205 |
| 2015/0106084 | A1 | 4/2015 | Atti et al. | |
| 2015/0106102 | A1 | 4/2015 | Chebiyyam et al. | |
| 2015/0106107 | A1 | 4/2015 | Atti et al. | |
| 2015/0170662 | A1 | 6/2015 | Krishnan et al. | |
| 2015/0279382 | A1 | 10/2015 | Atti et al. | |
| 2015/0317994 | A1* | 11/2015 | Ramadas | G10L 19/08 704/226 |

FOREIGN PATENT DOCUMENTS

| | | | |
|---|---|---|---|
| WO | WO2010057680 | A1 | 4/2015 |
| WO | WO2015054492 | A1 | 4/2015 |
| WO | WO2015095008 | A1 | 6/2015 |
| WO | WO2015153491 | A1 | 10/2015 |
| WO | WO2015167732 | A1 | 11/2015 |

* cited by examiner

HIGH-BAND SIGNAL CODING USING MISMATCHED FREQUENCY RANGES

I. CLAIM OF PRIORITY

The present application claims priority from U.S. Provisional Patent Application No. 62/017,753 entitled "HIGH-BAND SIGNAL CODING USING MISMATCHED FREQUENCY RANGES," filed Jun. 26, 2014, the contents of which are incorporated by reference in their entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Transmission of voice by digital techniques is widespread, particularly in long distance and digital radio telephone applications. There may be an interest in determining the least amount of information that can be sent over a channel while maintaining a perceived quality of reconstructed speech. If speech is transmitted by sampling and digitizing, a data rate on the order of sixty-four kilobits per second (kbps) may be used to achieve a speech quality of an analog telephone. Through the use of speech analysis, followed by coding, transmission, and re-synthesis at a receiver, a significant reduction in the data rate may be achieved.

Devices for compressing speech may find use in many fields of communications. An exemplary field is wireless communications. The field of wireless communications has many applications including, e.g., cordless telephones, paging, wireless local loops, wireless telephony such as cellular and personal communication service (PCS) telephone systems, mobile IP telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a CDMA system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems.

The IS-95 standard subsequently evolved into "3G" systems, such as cdma2000 and WCDMA, which provide more capacity and high speed packet data services. Two variations of cdma2000 are presented by the documents IS-2000 (cdma2000 1×RTT) and IS-856 (cdma2000 1×EV-DO), which are issued by TIA. The cdma2000 1×RTT communication system offers a peak data rate of 153 kbps whereas the cdma2000 1×EV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may comprise an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, one frame length is twenty milliseconds, which corresponds to 160 samples at a sampling rate of eight kilohertz (kHz), although any frame length or sampling rate deemed suitable for the particular application may be used.

The encoder analyzes the incoming speech frame to extract certain relevant parameters, and then quantizes the parameters into binary representation, e.g., to a set of bits or a binary data packet. The data packets are transmitted over a communication channel (i.e., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits $N_i$ and a data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal.

Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Predictive (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_o$, for each frame) or at a variable rate (in which different bit rates are used for different types of frame contents). Variable-rate coders attempt to use the amount of bits needed to encode the codec parameters to a level adequate to obtain a target quality.

Time-domain coders such as the CELP coder may rely upon a high number of bits, $N_o$, per frame to preserve the accuracy of the time-domain speech waveform. Such coders may deliver excellent voice quality provided that the number of bits, $N_o$, per frame is relatively large (e.g., 8 kbps or above). At low bit rates (e.g., 4 kbps and below), time-domain coders may fail to retain high quality and robust performance due to the limited number of available bits. At low bit rates, the limited codebook space clips the waveform-matching capability of time-domain coders, which are deployed in higher-rate commercial applications. Hence, despite improvements over time, many CELP coding systems operating at low bit rates suffer from perceptually significant distortion characterized as noise.

An alternative to CELP coders at low bit rates is the "Noise Excited Linear Predictive" (NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

There may be research interest and commercial interest in improving audio quality of a speech signal (e.g., a coded speech signal, a reconstructed speech signal, or both). For example, a communication device may receive a speech signal with lower than optimal voice quality. To illustrate, the communication device may receive the speech signal from another communication device during a voice call. The voice call quality may suffer due to various reasons, such as environmental noise (e.g., wind, street noise), limitations of the interfaces of the communication devices, signal processing by the communication devices, packet loss, bandwidth limitations, bit-rate limitations, etc.

In traditional telephone systems (e.g., public switched telephone networks (PSTNs)), signal bandwidth is limited to the frequency range of 300 Hertz (Hz) to 3.4 kHz. In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 0 Hz to 6.4 kHz, also called the "low-band"). For example, the low-band may be represented using filter parameters and/or a low-band excitation signal. However, in order to improve coding efficiency, the higher frequency portion of the signal (e.g., 6.4 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc.

Predicting the high-band using signal modeling may include generating a high-band excitation signal based on data (e.g., a low-band excitation signal) associated with the low-band. However, generating the high-band excitation signal may include pole-zero filtering operations and down-mixing operations, which may be complex and computationally expensive.

IV. SUMMARY

According to one example of the techniques disclosed herein, a method includes receiving an audio signal at an encoder and generating, at the encoder, a first signal corresponding to a component of a high-band portion of the audio signal. The first component has a first frequency range. The method includes generating, at the encoder, a high-band excitation signal corresponding to a second component of the high-band portion of the audio signal. The second component has a second frequency range that differs from the first frequency range. The method includes providing, at the encoder, the high-band excitation signal to a filter having filter coefficients generated based on the first signal to generate a synthesized version of the high-band portion of the audio signal.

According to another example of the techniques disclosed herein, an encoder includes first circuitry in a baseband signal generation path and second circuitry in a high-band excitation signal generation path. The first circuitry is configured to generate a first signal corresponding to a first component of a high-band portion of an audio signal. The first component has a first frequency range. The second circuitry is configured to generate a high-band excitation signal corresponding to a second component of the high-band portion of the audio signal. The second component has a second frequency range that differs from the first frequency range. The encoder also includes a filter having filter coefficients generated based on the first signal and configured to receive the high-band excitation signal and to generate a synthesized version of the high-band portion of the audio signal.

According to another example of the techniques disclosed herein, an apparatus includes means for generating a first signal corresponding to a first component of a high-band portion of an input audio signal. The first component has a first frequency range. The apparatus also includes means for generating a high-band excitation signal corresponding to a second component of the high-band portion of the audio signal. The second component has a second frequency range that differs from the first frequency range. The apparatus also includes means for generating a synthesized version of the high-band portion of the audio signal. The means for generating the synthesized version is configured to receive the high-band excitation signal and has filter coefficients generated based on the first signal.

According to another example of the techniques disclosed herein, a non-transitory computer-readable medium includes instructions that, when executed by an encoder, cause the encoder to generate a first signal corresponding to a first component of a high-band portion of a received audio signal and to generate a high-band excitation signal corresponding to a second component of the high-band portion of the audio signal. The first component has a first frequency range and the second component has a second frequency range that differs from the first frequency range. The instructions also cause the encoder to provide the high-band excitation signal to a filter having filter coefficients generated based on the first signal to generate a synthesized version of the high-band portion of the audio signal.

According to another example of the techniques disclosed herein, a method includes receiving an encoded version of an audio signal at a decoder. The encoded version includes first data corresponding to a low-band portion of the audio signal and second data corresponding to a first component of a high-band portion of the audio signal. The first component has a first frequency range. The method includes generating, at the decoder, a high-band excitation signal based on the first data. The high-band excitation signal corresponds to a second component of the high-band portion of the audio signal. The second component has a second frequency range that differs from the first frequency range. The method also includes providing, at the decoder, the high-band excitation signal to a filter having filter coefficients generated based on the second data to generate a synthesized version of the high-band portion of the audio signal.

According to another example of the techniques disclosed herein, a decoder includes first circuitry in a high-band excitation signal generation path. The first circuitry is configured to generate a high-band excitation signal based on first data corresponding to a low-band portion of an audio signal. The audio signal corresponds to a received encoded audio signal that includes the first data and that further includes second data corresponding to a first component of a high-band portion of the audio signal. The first component has a first frequency range. The high-band excitation signal corresponds to a second component of the high-band portion of the audio signal, and the second component has a second frequency range that differs from the first frequency range. The decoder also includes a filter configured to receive the high-band excitation signal and having filter coefficients generated based on the second data. The filter is configured to generate a synthesized version of the high-band portion of the audio signal.

According to another example of the techniques disclosed herein, an apparatus includes means for generating a high-band excitation signal based on first data corresponding to a low-band portion of an audio signal. The audio signal corresponds to a received encoded audio signal that includes the first data and that further includes second data corresponding to a first component of a high-band portion of the audio signal. The first component has a first frequency range. The high-band excitation signal corresponds to a second component of the high-band portion of the audio signal. The second component has a second frequency range that differs from the first frequency range. The apparatus also includes means for generating a synthesized version of the high-band portion of the audio signal. The means for generating the synthesized version is configured to receive the high-band excitation signal and has filter coefficients generated based on the second data.

According to another example of the techniques disclosed herein, a non-transitory computer-readable medium includes instructions that, when executed by a processor within a decoder, cause the processor to receive an encoded version of an audio signal. The encoded version includes first data corresponding to a low-band portion of the audio signal and second data corresponding to a first component of a high-band portion of the audio signal. The first component has a first frequency range. The instructions cause the processor to generate a high-band excitation signal based on the first data, the high-band excitation signal corresponding to a second component of the high-band portion of the audio signal. The second component has a second frequency range that differs from the first frequency range. The instructions also cause the processor to provide the high-band excitation signal to a filter having filter coefficients generated based on the second data to generate a synthesized version of the high-band portion of the audio signal.

V. BRIEF DESCRIPTION OF THE DRAWINGS

Figure 3:
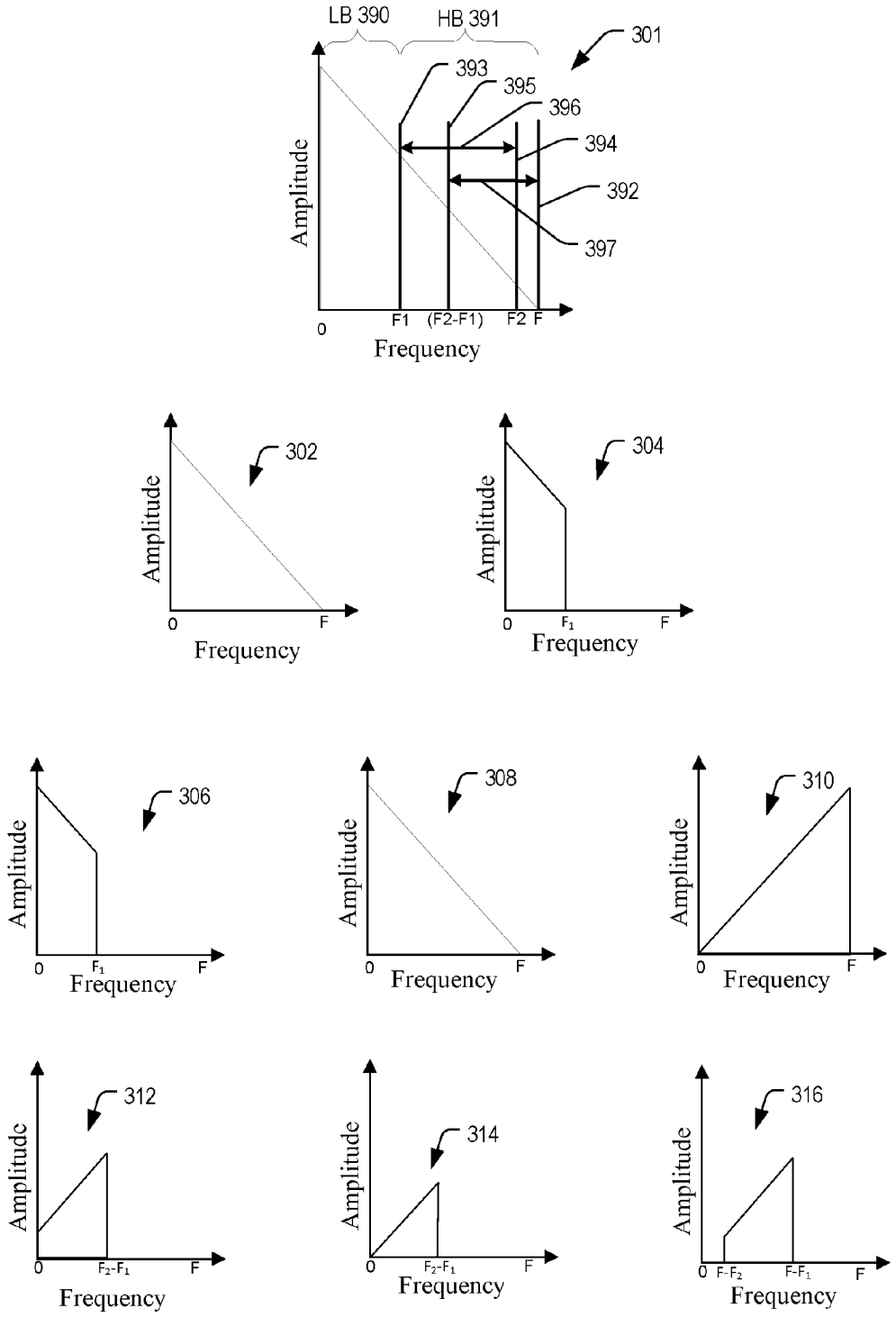
Figure 4:
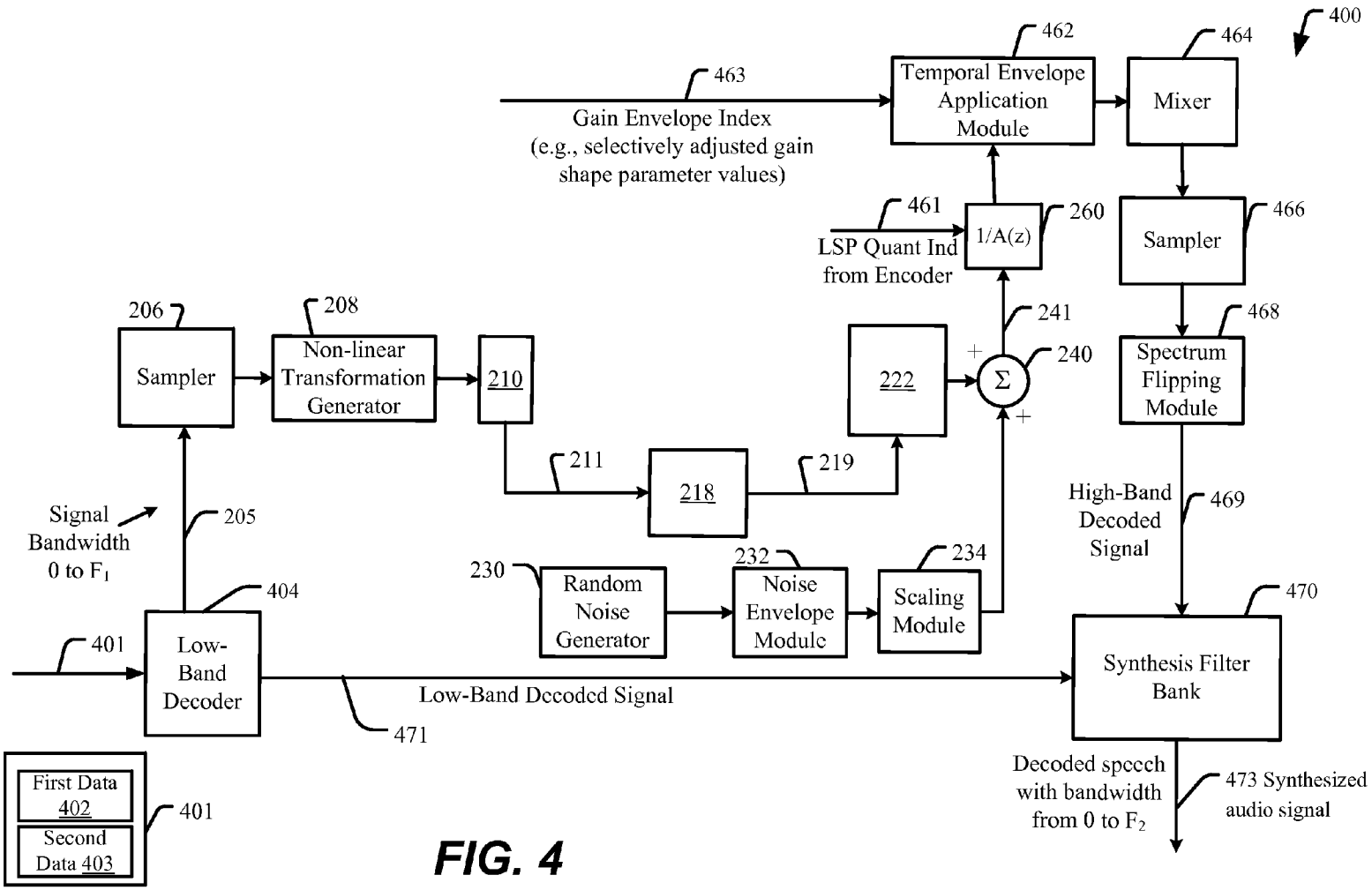
Figure 5:
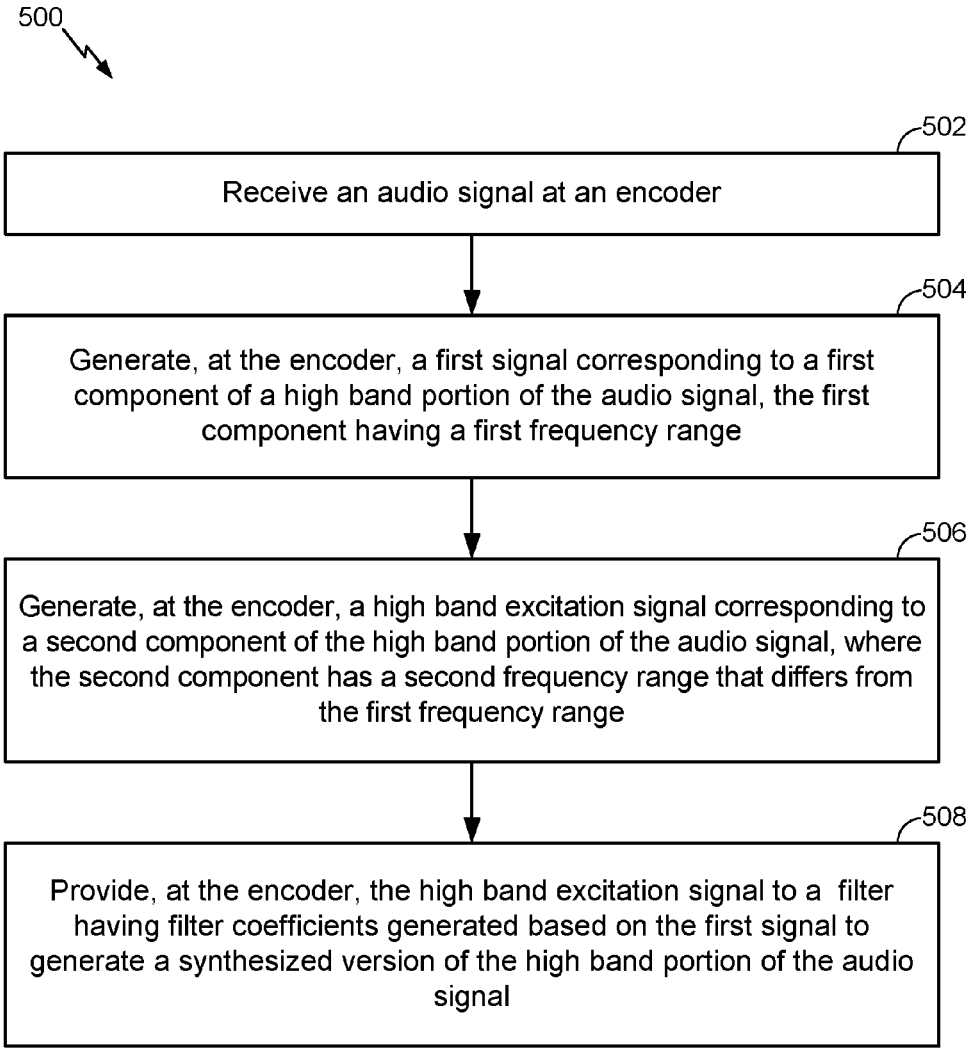
Figure 6:
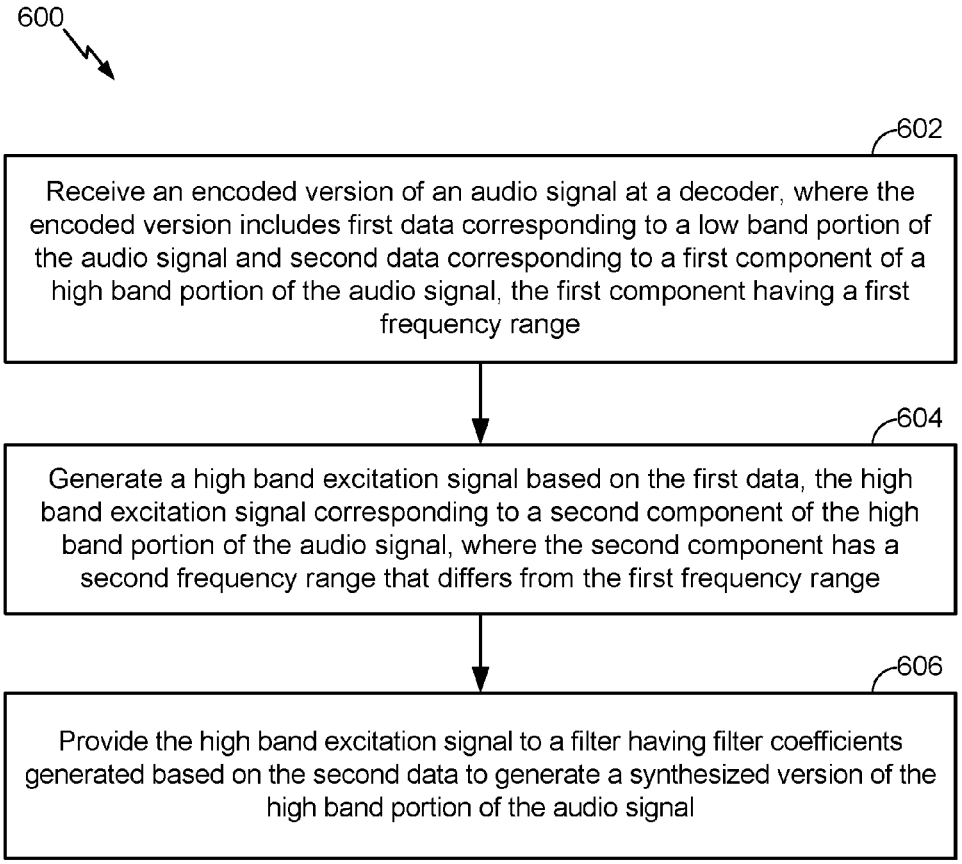
Figure 7:
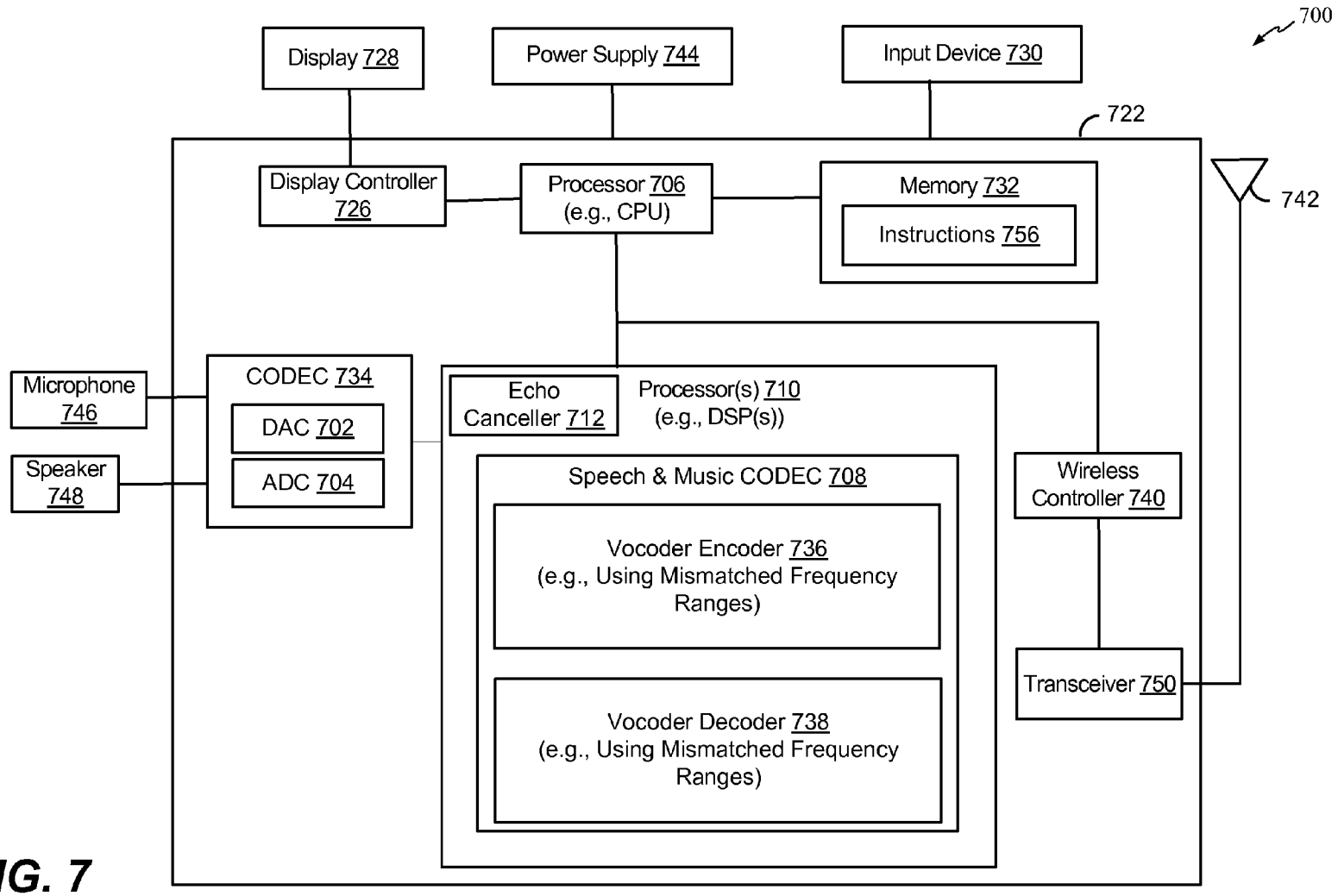

FIG. 3 includes diagrams illustrating frequency components of signals according to a particular implementation;

FIG. 4 is a diagram illustrating components of a decoder operable to synthesize a high-band portion of an audio signal by use of mismatched frequency ranges;

FIG. 5 depicts a flowchart of a method of encoding an audio signal by use of mismatched frequency ranges;

FIG. 6 depicts a flowchart of a method of decoding an encoded audio signal by use of mismatched frequency ranges; and FIG. 7 is a block diagram of a wireless device operable to perform signal processing operations in accordance with the systems, diagrams, and methods of FIGS. 1-6.

VI. DETAILED DESCRIPTION

Techniques for encoding an audio signal using mismatched frequency ranges of a high-band portion of the audio signal are disclosed. An encoder (e.g., a speech encoder or "vocoder") may generate side-band information such as filter coefficients corresponding to a first component in a first frequency range (e.g., 6.4 kHz-14.4 kHz) of the high-band portion of the audio signal. The encoder may also generate a high-band excitation signal corresponding to a second component in a second frequency range (e.g., 8 kHz-16 kHz) of the high-band portion of the audio signal. Although the first frequency range differs from the second frequency range (i.e., the frequency ranges are mismatched), the encoder filters the high-band excitation signal based on the filter coefficients to generate a synthesized version of the high-band portion of the audio signal. Using the high-band excitation signal corresponding to the second frequency range instead of the first frequency range enables the high-band excitation signal to be generated without using high-complexity components such as pole-zero filters and/or down-mixers.

Figure 1:
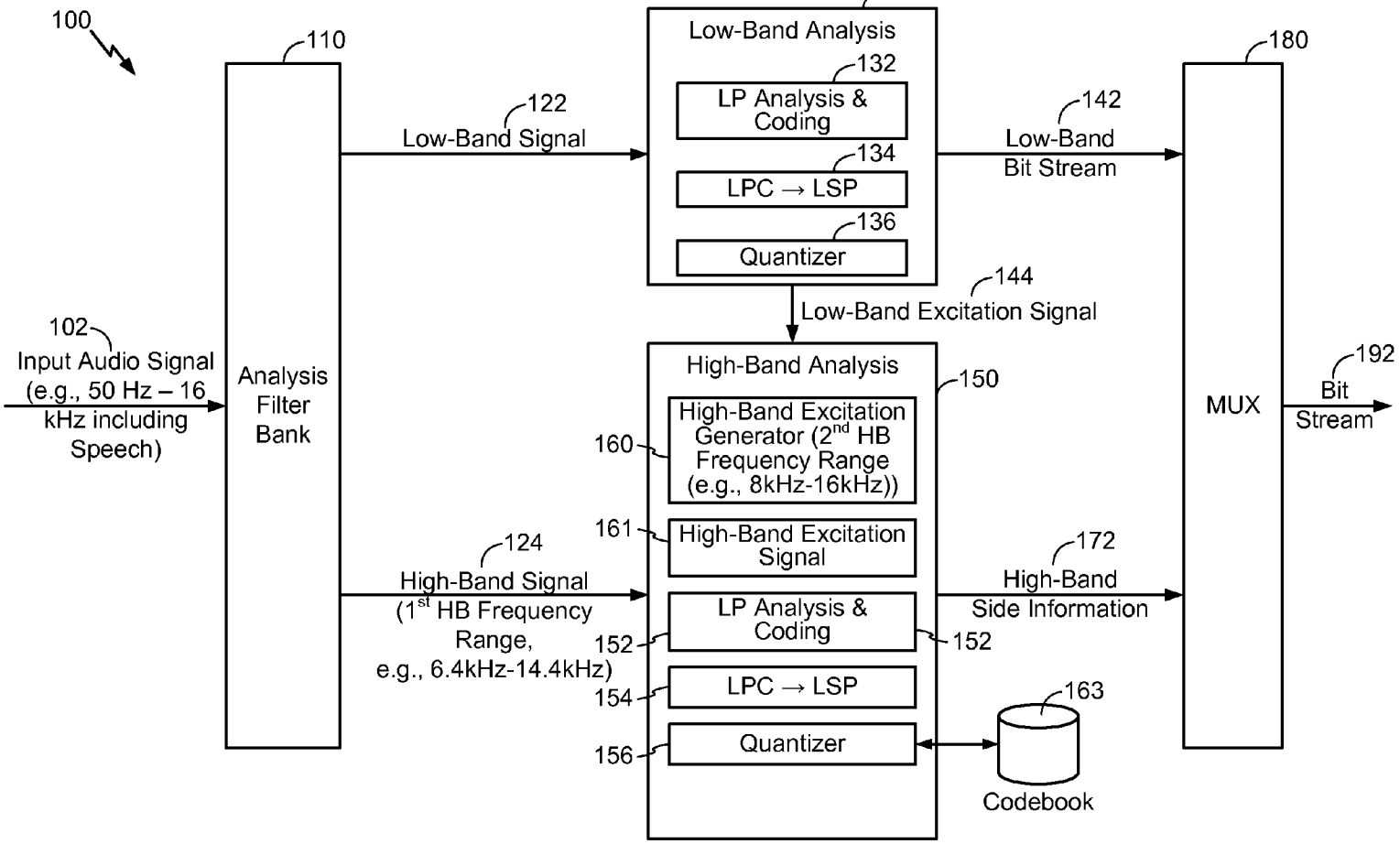
FIG. 1 is a diagram of a system that is operable to encode a high-band portion of an audio signal by use of mismatched frequency ranges.

Referring to FIG. 1, a system that is operable to perform noise modulation and gain adjustment is shown and generally designated 100. According to one implementation, the system 100 may be integrated into an encoding system or apparatus (e.g., in a wireless telephone or coder/decoder (CODEC)). The system 100 is configured to encode a high-band portion of an input signal using mismatched frequencies. For example, a first component of the high-band portion in a first frequency range may be analyzed to generate filter coefficients for a synthesis filter, while a second component of the high-band portion in a different frequency range may be used to generate an excitation signal for the synthesis filter.

It should be noted that in the following description, various functions performed by the system 100 of FIG. 1 are described as being performed by certain components or modules. However, this division of components and modules is for illustration only. According to another implementation, a function performed by a particular component or module may instead be divided amongst multiple components or modules. Moreover, in another implementation, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. According to one implementation, the input audio signal 102 may include speech. The input audio signal 102 may be a super wideband (SWB) signal that includes data in the frequency range from approximately 50 hertz (Hz) to approximately 16 kHz. The analysis filter bank 110 may filter the input audio signal 102 into multiple portions based on frequency. For example, the analysis filter bank 110 may generate a low-band signal 122 and a high-band signal 124. The low-band signal 122 and the high-band signal 124 may have equal or unequal bandwidths, and may be overlapping or non-overlapping. According to another implementation, the analysis filter bank 110 may generate more than two outputs.

In the example of FIG. 1, the low-band signal 122 and the high-band signal 124 occupy non-overlapping frequency bands. For example, the low-band signal 122 and the high-band signal 124 may occupy non-overlapping frequency bands of 50 Hz-7 kHz and 7 kHz-16 kHz, respectively. According to another implementation, the low-band signal 122 and the high-band signal 124 may occupy non-overlapping frequency bands of 50 Hz-8 kHz and 8 kHz-16 kHz, respectively. According to another implementation, the low-band signal 122 and the high-band signal 124 overlap (e.g., 50 Hz-8 kHz and 7 kHz-16 kHz), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

It should be noted that although the example of FIG. 1 illustrates processing of a SWB signal, this is for illustration only. According to another implementation, the input audio signal 102 may be a wideband (WB) signal having a frequency range of approximately 50 Hz to approximately 8 kHz. In such an implementation, the low-band signal 122 may correspond to a frequency range of approximately 50 Hz to approximately 6.4 kHz, and the high-band signal 124 may correspond to a frequency range of approximately 6.4 kHz to approximately 8 kHz.

The system 100 may include a low-band analysis module 130 configured to receive the low-band signal 122. According to one implementation, the low-band analysis module 130 may represent a code excited linear prediction (CELP) encoder. The low-band analysis module 130 may include a LP analysis and coding module 132, a linear prediction coefficient (LPC) to line spectral pair (LSP) transform module 134, and a quantizer 136. LSPs may also be referred to as line spectral frequencies (LSFs), and the two terms may be used interchangeably herein. The LP analysis and coding module 132 may encode a spectral envelope of the low-band signal 122 as a set of LPCs. LPCs may be generated for each frame of audio (e.g., 20 ms of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. According to one implementation, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 from the analysis filter bank 110 and the low-band excitation signal 144 from the low-band analysis module 130. The high-band analysis module 150 may generate high-band side information 172 based on the high-band signal 124 and the low-band excitation signal 144. For example, the high-band side information 172 may include high-band LSPs and/or gain information (e.g., based on at least a ratio of high-band energy to low-band energy), as further described herein.

The high-band analysis module 150 may include a high-band excitation generator 160. The high-band excitation generator 160 may generate a high-band excitation signal 161 by extending a spectrum of the low-band excitation signal 144 into the second high-band frequency range (e.g., 8 kHz-16 kHz). To illustrate, the high-band excitation generator 160 may apply a transform to the low-band excitation signal (e.g., a non-linear transform such as an absolute-value or square operation) and may mix the transformed low-band excitation signal with a noise signal (e.g., white noise modulated according to an envelope corresponding to the low-band excitation signal 144 that mimics slow varying temporal characteristics of the low-band signal 122) to generate the high-band excitation signal 161.

The high-band excitation signal 161 may be used to determine one or more high-band gain parameters that are included in the high-band side information 172. As illustrated, the high-band analysis module 150 may also include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). The LP analysis and coding module 152 may generate a set of LPCs that are transformed to LSPs by the transform module 154 and quantized by the quantizer 156 based on a codebook 163. For example, the LP analysis and coding module 152, the transform module 154, and the quantizer 156 may use the high-band signal 124 to determine high-band filter information (e.g., high-band LSPs) that is included in the high-band side information 172. According to one implementation, the high-band side information 172 may include high-band LSPs as well as high-band gain parameters. The high-band analysis module 150 may include a local decoder that uses filter coefficients based on the LPCs generated by the transform module 154 and that receives the high-band excitation signal 161 as an input. An output of the synthesis filter of the local decoder (e.g., a synthesized version of the high-band signal 124) may be compared to the high-band signal 124 and gain parameters (e.g., a frame gain and/or temporal envelope gain shaping values) may be determined, quantized, and included in the high-band side information 172.

The low-band bit stream 142 and the high-band side information 172 may be multiplexed by a multiplexer (MUX) 180 to generate an output bit stream 192. The output bit stream 192 may represent an encoded audio signal corresponding to the input audio signal 102. For example, the output bit stream 192 may be transmitted (e.g., over a wired, wireless, or optical channel) and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 192 may represent low-band data. The high-band side information 172 may be used at a receiver to regenerate the high-band excitation signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signal 124 from the output bit stream 192.

By generating the high-band excitation signal 161 corresponding to the second frequency range that does not match the first frequency range of the high-band signal 124, the system 100 may reduce complex and computationally expensive operations associated with a pole-zero filtering and down-mixing operations as described further with respect to FIGS. 2A-4. Illustrative examples of using mismatched frequencies are described in further detail with respect to FIGS. 2A-4.

Figure 2A:
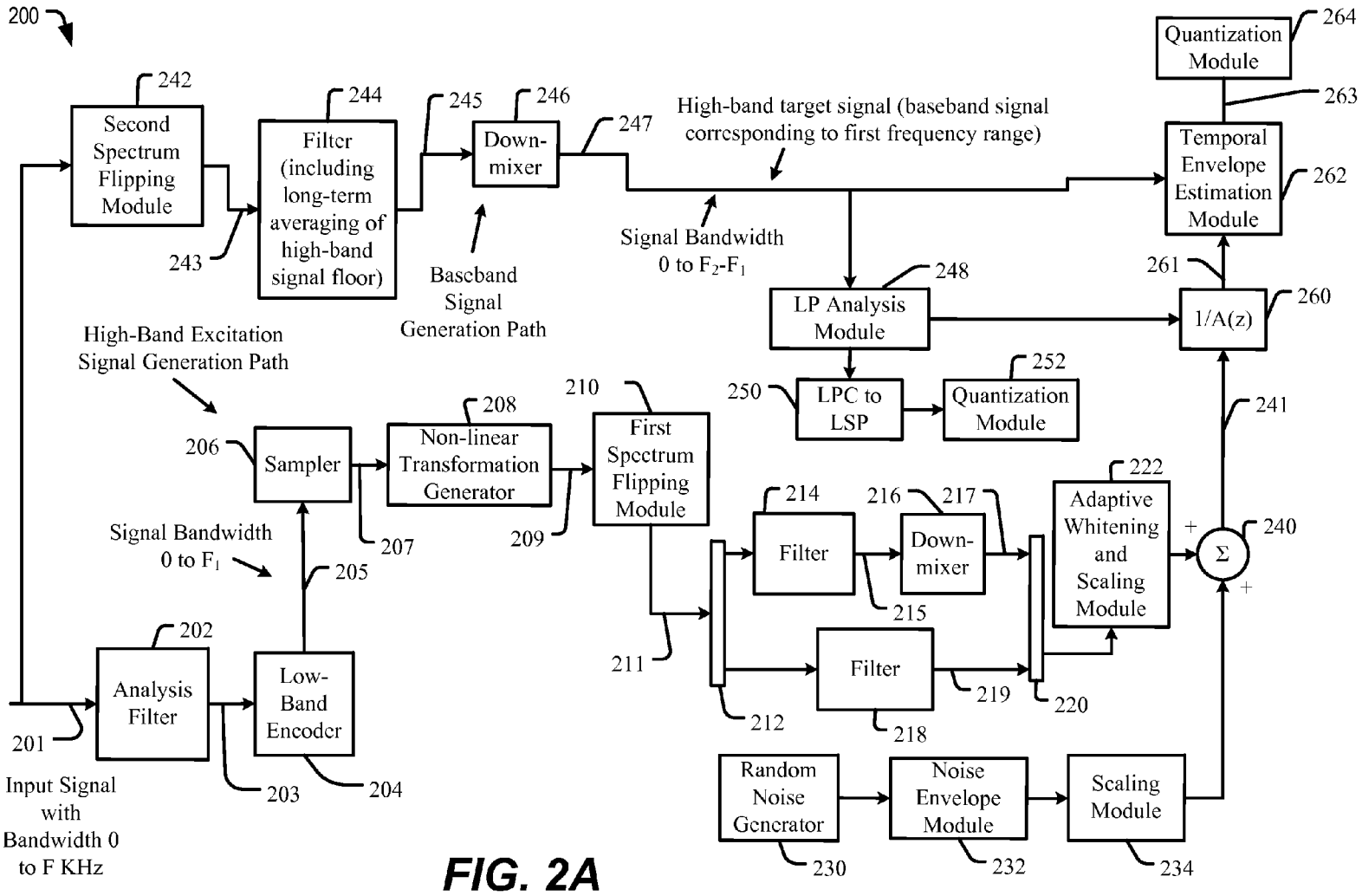
FIG. 2A is a diagram illustrating components of an encoder operable to encode a high-band portion of an audio signal by use of mismatched frequency ranges.

Referring to FIG. 2A, components used in an encoder 200 is shown, and graphs depicting frequency components of various signals that may represent signals of the encoder 200 are depicted in FIG. 3. The encoder 200 may correspond to the system 100 of FIG. 1.

An input signal 201 with a bandwidth of "F" (e.g., a signal having a frequency range from 0 Hz-F Hz, such as 0 Hz-16 kHz when F=16,000=16 k) may be received by the encoder 200. The input signal 201 may have frequency components such as illustrated in a graph 302 of FIG. 3. The graphs in FIG. 3 are illustrative and some features may be emphasized for clarity. The graphs of FIG. 3 provide a simplified, non-limiting example according to one implementation to graphically illustrate simplified frequency spectrums of various signals that may be generated during encoding and/or decoding and are not necessarily drawn to scale. A graph 301 of FIG. 3 illustrates an example of frequency components of the input signal 201 having a low-band (LB) portion 390 from 0 Hz to a frequency F1 393 and having a high-band (HB) portion 391 from F1 Hz to an upper frequency F 392 of the input signal 201. A first component of the high-band portion has a first frequency range 396 that spans from F1 393 to a frequency F2 394. A second component of the high-band portion has a second frequency range 397 that spans from (F2−F1) 395 to F 392 or F1+(F−F2) to F 392. The first frequency range 396 of the input signal 201 may be used to generate filter coefficients, and the second frequency range 397 may be used to generate a high-band excitation signal, as described below.

An analysis filter 202 may output a low-band portion of the input signal 201. The signal 203 output from the analysis filter 202 may have frequency components from 0 Hz to F1 Hz (such as 0 Hz-6.4 kHz when F1=6.4 k).

A low-band encoder 204, such as an ACELP encoder (e.g., the LP analysis and coding module 132 in the low-band analysis module 130 of FIG. 1), may encode the signal 203. The low-band encoder 204 may generate coding information, such as LPCs, and a low-band excitation signal 205. The low-band excitation signal 205 may have frequency components such as illustrated in the graph 304 of FIG. 3.

The low-band excitation signal 205 from the ACELP encoder (which may also be reproduced by an ACELP decoder in a receiver, such as described in FIG. 4) may be upsampled at a sampler 206 so that the effective bandwidth of an upsampled signal 207 is in a frequency range from 0 Hz to F Hz. The low-band excitation signal 205 may be received by the sampler 206 as a set of samples corresponding to a sampling rate of 12.8 kHz (e.g., the Nyquist sampling rate of a 6.4 kHz low-band excitation signal 205). For example, the low-band excitation signal 205 may be sampled at twice or 2.5 times the rate of the bandwidth of the low-band excitation signal 205. The upsampled signal 207 may have frequency components such as illustrated in a graph 306 of FIG. 3.

A non-linear transformation generator 208 may be configured to generate a bandwidth-extended signal 209, illustrated as a non-linear excitation signal based on the upsampled signal 207. For example, the non-linear transformation generator 208 may perform a non-linear transformation operation (e.g., an absolute-value operation or a square operation) on the upsampled signal 207 to generate the bandwidth-extended signal 209. The non-linear transformation operation may extend the harmonics of the original signal, the low-band excitation signal 205 from 0 Hz to F1 Hz (e.g., 0 Hz to 6.4 kHz), into a higher band, such as from 0 Hz to F Hz (e.g., from 0 Hz to 16 kHz). The bandwidth-extended signal 209 may have frequency components such as illustrated in a graph 308 of FIG. 3.

The bandwidth-extended signal 209 may be provided to a first spectrum flipping module 210. The first spectrum flipping module 210 may be configured to perform a spectrum mirror operation (e.g., "flip" the spectrum) of the bandwidth-extended signal 209 to generate a "flipped" signal 211. Flipping the spectrum of the bandwidth-extended signal 209 may change (e.g., "flip") the contents of the bandwidth-extended signal 209 to opposite ends of the spectrum ranging from 0 Hz to F Hz (e.g., from 0 Hz to 16 kHz) of the flipped signal 211. For example, content at 14.4 kHz of the bandwidth-extended signal 209 may be at 1.6 kHz of the flipped signal 211, content at 0 Hz of the bandwidth-extended signal 209 may be at 16 kHz of the flipped signal 211, etc. The flipped signal 211 may have frequency components such as illustrated in a graph 310 of FIG. 3.

The flipped signal 211 may be provided to an input of a switch 212 that selectively routes the flipped signal 211 in a first mode of operation to a first path that includes a filter 214 and a down-mixer 216, or in a second mode of operation to a second path that includes a filter 218. For example, the switch 212 may include a multiplexer responsive to a signal at a control input that indicates the operating mode of the encoder 200.

In the first mode of operation, the flipped signal 211 may be band-pass filtered at the filter 214 to generate a band-pass signal 215 with reduced or removed signal content outside of the frequency range from (F−F2) Hz to (F−F1) Hz, where F2>F1. For example, when F=16 k, F1=6.4 k, and F2=14.4 k, the flipped signal 211 may be band-pass filtered to the frequency range 1.6 kHz to 9.6 kHz. The filter 214 may include a pole-zero filter configured to operate as a low-pass filter having a cutoff frequency at approximately F−F1 (e.g., at 16 kHz−6.4 kHz=9.6 kHz). For example, the pole-zero filter may be a high-order filter having a sharp drop-off at the cutoff frequency and configured to filter out high-frequency components of the flipped signal 211 (e.g., filter out components of the flipped signal 211 between (F−F1) and F, such as between 9.6 kHz and 16 kHz). In addition, the filter 214 may include a high-pass filter configured to attenuate frequency components in an output signal that are below F−F2 (e.g., below 16 kHz−14.4 kHz=1.6 kHz).

The band-pass signal 215 may be provided to the down-mixer 216, which may generate a signal 217 having an effective signal bandwidth extending from 0 Hz to (F2−F1) Hz, such as from 0 Hz to 8 kHz. For example, the down-mixer 216 may be configured to down-mix the band-pass signal 215 from the frequency range between 1.6 kHz and 9.6 kHz to baseband (e.g., a frequency range between 0 Hz and 8 kHz) to generate the signal 217. The down-mixer 216 may be implemented using two-stage Hilbert transforms. For example, the down-mixer 216 may be implemented using two fifth-order infinite impulse response (IIR) filters having imaginary and real components, which may result in complex and computationally expensive operations. The signal 217 may have frequency components such as illustrated in a graph 312 of FIG. 3.

In the second mode of operation, the switch 212 provides the flipped signal 211 to the filter 218 to generate a signal 219. The filter 218 may operate as a low pass filter to attenuate frequency components above (F2−F1) Hz (e.g., above 8 kHz). The low pass filtering at the filter 218 may be performed as part of a resampling process where the sample rate is converted to 2*(F2−F1) (e.g., to 2*(14.4 Hz−6.4 Hz=16 kHz). The signal 219 may have frequency components such as illustrated in a graph 314 of FIG. 3.

A switch 220 outputs one of the signals 217, 219 to be processed at an adaptive whitening and scaling module 222 according to the mode of operation, and an output of the adaptive whitening and scaling module is provided to a first input of a combiner 240, such as an adder. A second input of the combiner 240 receives a signal resulting from an output of a random noise generator 230 that has been processed according to a noise envelope module 232 (e.g., a modulator) and a scaling module 234. The combiner 240 generates a high-band excitation signal 241, such as the high-band excitation signal 161 of FIG. 1.

The input signal 201 that has an effective bandwidth in the frequency range between 0 Hz and F Hz may also be processed at a baseband signal generation path. For example, the input signal 201 may be spectrally flipped at a second spectrum flipping module 242 to generate a flipped signal 243. The flipped signal 243 may be band-pass filtered at a filter 244 to generate a band-pass signal 245 having removed or reduced signal components outside the frequency range from (F−F2) Hz to (F−F1) Hz (e.g., from 1.6 kHz to 9.6 kHz). The band-pass signal 245 may then be down-mixed at a down-mixer 246 to generate the high-band "target" signal 247 having an effective signal bandwidth in the frequency range from 0 Hz to (F2−F1) Hz (e.g., from 0 Hz to 8 kHz, or 0 Hz to F1+(F−F2) Hz). The flipped signal 243 may have frequency components such as illustrated in the graph 310 of FIG. 3. The band-pass signal 245 may have frequency components such as illustrated in the graph 316 of FIG. 3. The high-band target signal 247 is a baseband signal corresponding to the first frequency range and may have frequency components such as illustrated in the graph 312 of FIG. 3.

Parameters representing the modifications to the high-band excitation signal 241 so that it represents the high-band target signal 247 may be extracted and transmitted to the decoder. To illustrate, the high-band target signal 247 may be processed by an LP analysis module 248 to generate LPCs that are converted to LSPs at a LPC-to-LSP converter 250 and quantized at a quantization module 252. The quantization module 252 may generate LSP quantization indices to be sent to the decoder, such as in the high-band side information 172 of FIG. 1.

The LPCs may be used to configure a synthesis filter 260 that receives the high-band excitation signal 241 as an input and generates a synthesized high-band signal 261 as an output. The synthesized high-band signal 261 is compared to the high-band target signal 247 (e.g., energies of the signals 261 and 247 may be compared at each sub-frame of the respective signals) at a temporal envelope estimation module 262 to generate gain information 263, such as gain shape parameter values. The gain information 263 is provided to a quantization module 264 to generate quantized gain information indices to be sent to the decoder, such as in the high-band side information 172 of FIG. 1.

As described with respect to the first path, in the first mode of operation the high-band excitation signal 241 generation path includes a downmix operation to generate the signal 217. This downmix operation can be complex if implemented through Hilbert transformers. An alternate implementation based on quadrature mirror filters (QMFs) can result in significantly higher overall system delays. However, in the second mode of operation, the downmix operation is not included in high-band excitation signal 241 generation path. This may result in a mismatch between the high-band excitation signal 241 and the high-band target signal 247, as can be graphically visualized via comparison of the graph 312 to the graph 314 of FIG. 3.

It will be appreciated that generating the high-band excitation signal 241 according to the second mode (e.g., using the filter 218) may bypass the filter 214 (e.g., the pole-zero filter) and the down-mixer 216 and reduce complex and computationally expensive operations associated with pole-zero filtering and the down-mixer. Although FIG. 2A describes the first path (including the filter 214 and the down-mixer 216) and the second path (including the filter 218) as being associated with distinct operation modes of the encoder 200, in other implementations, the encoder 200 may be configured to operate in the second mode without being configurable to also operate in the first mode (e.g., the encoder 200 may omit the switch 212, the filter 214, the down-mixer 216, and the switch 220, having the input of the filter 218 coupled to receive the flipped signal 211 and having the signal 219 provided to the input of the adaptive whitening and scaling module 222).

Figure 2B:
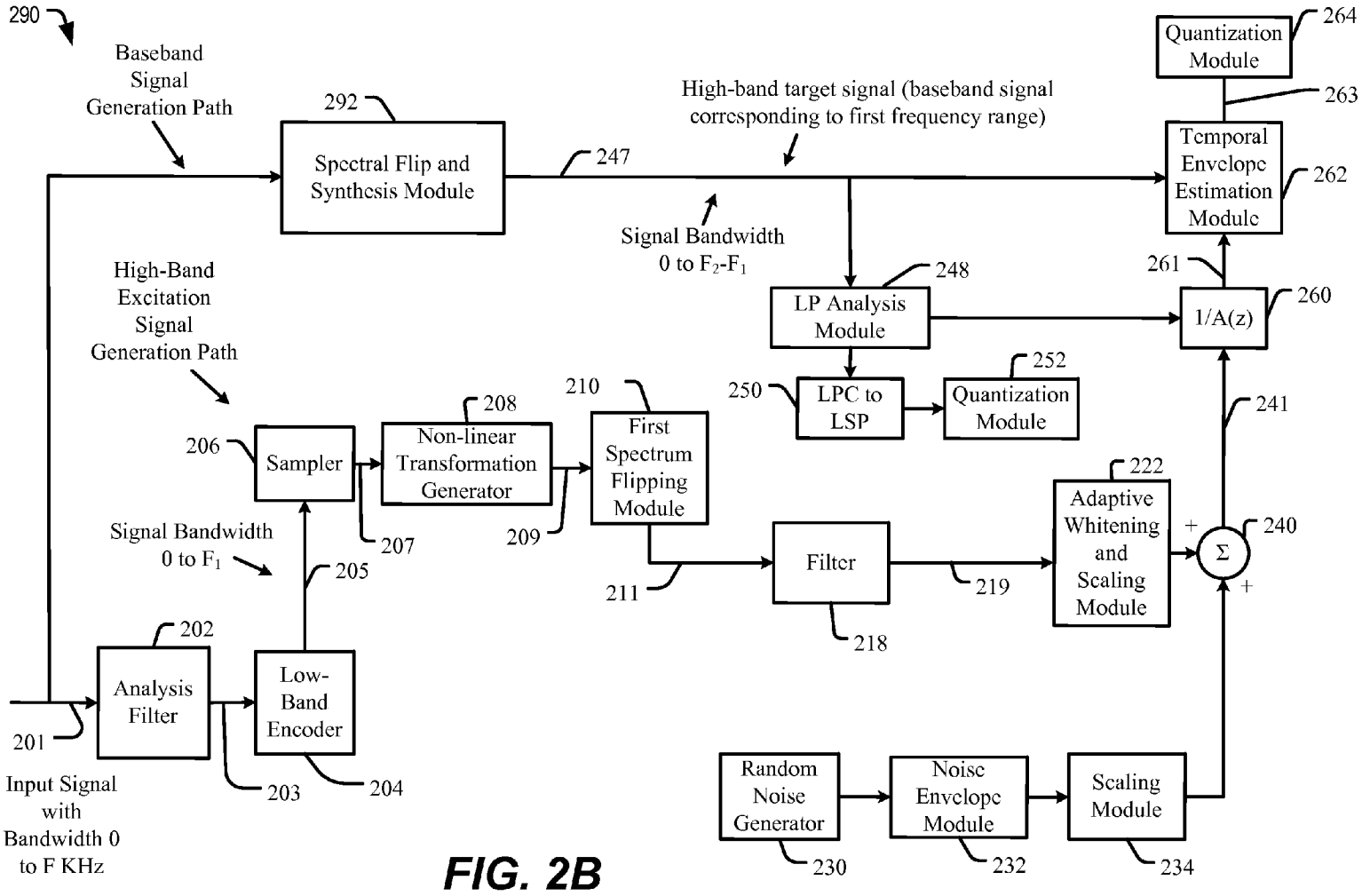
FIG. 2B is another diagram illustrating components of an encoder operable to encode a high-band portion of an audio signal by use of mismatched frequency ranges.

Referring to FIG. 2B, components used in an encoder 290 are shown. The components in the encoder 290 may be included in the system 100 of FIG. 1. The encoder 290 may operate in a substantially similar manner as the encoder 200 of FIG. 2A. For example, similar components in the encoder 290 and the encoder 200 of FIG. 2A have identical numerical indicators and may operate in a substantially similar manner.

The encoder 290 includes a spectral flip and synthesis module 292 in the baseband signal generation path. The spectral flip and synthesis module 292 may be configured to receive the input signal 201. The spectral flip and synthesis module 292 may be configured to perform a spectral flip and synthesis operation on the input signal 201 to generate the baseband signal 247. According to one implementation, the spectral flip and synthesis module 292 may include a QMF filter bank that is operable to perform the spectral flip and synthesis operation on the input signal 201.

To illustrate, the input signal 201 may have signal components from 0 Hz to 16 kHz. The QMF filter bank (e.g., the spectral flip and synthesis module 292) may perform a synthesis operation to "map" signal components from 6 kHz to 14 kHz in a synthesis stage, and the resulting signal may be flipped to generate the baseband signal 247. Thus, in some implementations, the spectrum flipping operations of the second spectrum flipping module 242 of FIG. 2A, the band-pass filtering operations of the filter 244 of FIG. 2A, and the down-mixing operations of the down-mixer 246 of FIG. 2A may be implicitly performed using a QMF filter bank to generate the baseband signal 247. Thus, the spectrum flipping operations, the band-pass filtering operations, and the down-mixing operations described with respect to the baseband signal generation path of FIG. 2A may be bypassed, and the spectral flip and synthesis module 292 of FIG. 2B may implicitly perform a synthesis operation to generate the baseband signal 247.

The flipped signal 211 from the first spectrum flipping module 210 may be provided to the filter 218, and the filter 218 may filter the flipped signal 211 to generate the signal 219. The signal 219 may be provided to the input of the adaptive whitening and scaling module 222. Cost and design complexity of the encoder 200 of FIG. 2A may be reduced by implementing the techniques described herein using the encoder 290 of FIG. 2B (e.g., by removing the switches 212, 220, the filter 214, and the down-mixer 216 of FIG. 2A).

FIG. 4 depicts a decoder 400 that can be used to decode an encoded audio signal, such as an encoded audio signal generated by the system 100 of FIG. 1 or the encoder 200 of FIG. 2A.

The decoder 400 includes a low-band decoder 404, such as an ACELP core decoder, that receives an encoded audio signal 401. The encoded audio signal 401 is an encoded version of an audio signal, such as the input signal 201 of FIG. 2A, and includes first data 402 (e.g., a low-band excitation signal 205 and quantized LSP indices) corresponding to a low-band portion of the audio signal and second data 403 (e.g., gain envelope data 463 and quantized LSP indices 461) corresponding to a high-band portion of the audio signal.

The low-band decoder 404 generates a synthesized low-band decoded signal 471. High-band signal synthesis includes providing the low-band excitation signal 205 of FIG. 2A (or a representation of the low-band excitation signal 205, such as a quantized version of the low-band excitation signal 205 received from an encoder) to the sampler 206 of FIG. 2A. High-band synthesis includes generating the high-band excitation signal 241 using the sampler 206, the non-linear transformation generator 208, the first spectrum flipping module 210, the filter 218, and the adaptive whitening and scaling module 222 to provide a first input to the combiner 240 of FIG. 2A. A second input to the combiner is generated by an output of the random noise generator 230 processed by the noise envelope module 232 and scaled at the scaling module 234 of FIG. 2A.

The synthesis filter 260 of FIG. 2A may be configured in the decoder 400 according to LSP quantization indices received from an encoder, such as output by the quantization module 252 of the encoder 200 of FIG. 2A, and processes the excitation signal 241 output by the combiner 240 to generate a synthesized signal. The synthesized signal is provided to a temporal envelope application module 462 that is configured to apply one or more gains, such as gain shape parameter values (e.g., according to gain envelope indices output from the quantization module 264 of the encoder 200 of FIG. 2A) to generate an adjusted signal 463.

High-band synthesis continues with processing by a mixer 464 configured to upmix the adjusted signal from the frequency range of 0 Hz to (F2−F1) Hz to the frequency range of (F−F2) Hz to (F−F1) Hz (e.g., 1.6 kHz to 9.6 kHz). An upmixed signal output by the mixer 464 is upsampled at a sampler 466, and an upsampled output of the sampler 466 is provided to a spectral flip module 468 that may operate as described with respect to the first spectrum flipping module 210 to generate a high-band decoded signal 469 that has a frequency band extending from F1 Hz to F2 Hz.

The low-band decoded signal 471 output by the low-band decoder 404 (from 0 Hz to F1 Hz) and the high-band decoded signal 469 output from the spectral flip module 468 (from F1 Hz to F2 Hz) are provided to a synthesis filter bank 470. The synthesis filter bank 470 generates a synthesized audio signal 473, such as a synthesized version of the audio signal 201 of FIG. 2A, based on a combination of the low-band decoded signal 471 and the high-band decoded signal 469, and having a frequency range from 0 Hz to F2 Hz.

As described with respect to FIG. 2A, it will be appreciated that generating the high-band excitation signal 241 according to the second mode (e.g., using the filter 218) may bypass the filter 214 (e.g., the pole-zero filter) and the down-mixer 216 and reduce complex and computationally expensive operations associated with pole-zero filtering and the down-mixer. Although FIG. 4 describes the first path (including the filter 214 and the down-mixer 216) and the second path (including the filter 218) as being associated with distinct operation modes of the decoder 400, in other implementations, the decoder 400 may be configured to operate in the second mode without being configurable to also operate in the first mode (e.g., the decoder 400 may omit the switch 212, the filter 214, the down-mixer 216, and the switch 220, having the input of the filter 218 coupled to receive the flipped signal 211 and having the signal 219 provided to the input of the adaptive whitening and scaling module 222).

Referring to FIG. 5, a method is illustrated that may be performed by an encoder, such as the system 100 of FIG. 1 or the encoder 200 of FIG. 2A. An audio signal is received at the encoder, at 502. For example, the audio signal may be the input audio signal 102 of FIG. 1 or the input audio signal 201 of FIG. 2A.

A first signal corresponding to a first component of a high-band portion of the audio signal is generated at the encoder, at 504. The first component may have a first frequency range. For example, the first signal may be a baseband signal and may correspond to the high-band signal 124 of FIG. 1 or the baseband signal 247 of FIG. 2A. The first frequency range may correspond to the first frequency range 396 of FIG. 3.

A high-band excitation signal corresponding to a second component of the high-band portion of the audio signal is generated at the encoder, at 506. The second component has a second frequency range that differs from the first frequency range. The encoder may generate the high-band excitation signal without using a pole-zero filter and without using a down-mixing operation, such as by using the filter 218 of FIG. 2A (e.g., by bypassing or omitting the filter 214 and the down-mixer 216). For example, the high-band excitation signal may correspond to the high-band excitation signal 124 of FIG. 1 or the high-band excitation signal 241 of FIG. 2A.

The second frequency range may correspond to the second frequency range 397 of FIG. 3. For example, the first frequency range may correspond to a first frequency band spanning from a first frequency (e.g., F1 393) to a second frequency (e.g., F2 394), and the second frequency range may correspond to a second frequency band spanning from a difference between the second frequency and the first frequency (e.g., F2−F1 395) to an upper frequency (e.g., F 392) of the high-band portion audio signal. To illustrate, the first frequency band may span from approximately 6.4 kHz to approximately 14.4 kHz and the second frequency band may span from approximately 8 kHz to approximately 16 kHz.

The high-band excitation signal is provided to a filter having filter coefficients generated based on the first signal to generate a synthesized version of the high-band portion of the audio signal, at 508. For example, the high-band excitation signal 241 of FIG. 2A may be provided to the synthesis filter 260, which is responsive to data from the LP analysis module 248 generated based on the baseband signal 247 corresponding to the first frequency range.

The method FIG. 5 may reduce complex and computationally expensive operations associated with the filter 214 and the down-mixer 216.

Referring to FIG. 6, a method is illustrated that may be performed by a decoder, such as the decoder 400 of FIG. 4. An encoded version of an audio signal is received at a decoder, at 602. The encoded version includes first data corresponding to a low-band portion of the audio signal and second data corresponding to a first component of a high-band portion of the audio signal. The first component has a first frequency range. For example, the encoded version of the audio signal may be the encoded audio signal 401 of FIG. 4 including the first data 402 and the second data 404.

A high-band excitation signal is generated based on the first data, at 604. The high-band excitation signal corresponds to a second component of the high-band portion of the audio signal. The second component has a second frequency range that differs from the first frequency range. The decoder may generate the high-band excitation signal without using a pole-zero filter and without using a down-mixing operation, such as by using the filter 218 of FIG. 4 (e.g., by bypassing or omitting the filter 214 and the down-mixer 216). For example, the high-band excitation signal may correspond to the high-band excitation signal 241 of FIG. 4.

The second frequency range may correspond to the second frequency range 397 of FIG. 3. For example, the first frequency range may correspond to a first frequency band spanning from a first frequency (e.g., F1 393) to a second frequency (e.g., F2 394), and the second frequency range may correspond to a second frequency band spanning from a difference between the second frequency and the first frequency (e.g., F2−F1 395 or F1+(F−F2)) to an upper frequency (e.g., F 392) of the high-band portion audio signal. To illustrate, the first frequency band may span from approximately 6.4 kHz to approximately 14.4 kHz and the second frequency band may span from approximately 8 kHz to approximately 16 kHz.

The high-band excitation signal is provided to a filter having filter coefficients generated based on the second data to generate a synthesized version of the high-band portion of the audio signal, at 606. For example, the high-band excitation signal 241 of FIG. 4 is provided to the synthesis filter 260 of FIG. 4, and the synthesis filter 260 of FIG. 4 may have filter coefficients that are generated based on the quantized LSP indices 461 received in the second data 403 of FIG. 4.

The method FIG. 6 may reduce complex and computationally expensive operations associated with the filter 214 and the down-mixer 216.

One or more of the methods of FIGS. 5-6 may be implemented via hardware (e.g., an FPGA device, an ASIC, etc.) of a processing unit, such as a central processing unit (CPU), a DSP, or a controller, via a firmware device, or any combination thereof. As an example, one or more of the methods of FIGS. 5-6 can be performed by a processor that executes instructions, as described with respect to FIG. 7.

Referring to FIG. 7, a block diagram of a device (e.g., a wireless communication device) is depicted and generally designated 700. In various implementations, the device 700 may have fewer or more components than illustrated in FIG. 7. In an illustrative implementation, the device 700 may correspond to one or more of the systems of FIG. 1, 2A, 2B, or 4. In an illustrative implementation, the device 700 may operate according to one or more of the methods of FIGS. 5-6.

According to one implementation, the device 700 includes a processor 706 (e.g., a CPU). The device 700 may include one or more additional processors 710 (e.g., one or more DSPs). The processors 710 may include a speech and music coder-decoder (CODEC) 708 and an echo canceller 712. The speech and music CODEC 708 may include a vocoder encoder 736, a vocoder decoder 738, or both.

According to one implementation, the vocoder encoder 736 may include the system 100 of FIG. 1 or the encoder 200 of FIG. 2A. The vocoder encoder 736 may be configured to use mismatched frequency ranges (e.g., the first frequency range 396 and the second frequency range 397 of FIG. 3). The vocoder decoder 738 may include the decoder 400 of FIG. 4. The vocoder decoder 738 may be configured to use mismatched frequency ranges (e.g., the first frequency range 396 and the second frequency range 397 of FIG. 3). Although the speech and music CODEC 708 is illustrated as a component of the processors 710, in other implementations, one or more components of the speech and music CODEC 708 may be included in the processor 706, the CODEC 734, another processing component, or a combination thereof.

The device 700 may include a memory 732 and a wireless controller 740 coupled to an antenna 742 via transceiver 750. The device 700 may include a display 728 coupled to a display controller 726. A speaker 748, a microphone 746, or both may be coupled to the CODEC 734. The CODEC 734 may include a digital-to-analog converter (DAC) 702 and an analog-to-digital converter (ADC) 704.

According to one implementation, the CODEC 734 may receive analog signals from the microphone 746, convert the analog signals to digital signals using the analog-to-digital converter 704, and provide the digital signals to the speech and music CODEC 708, such as in a pulse code modulation (PCM) format. The speech and music CODEC 708 may process the digital signals. According to one implementation, the speech and music CODEC 708 may provide digital signals to the CODEC 734. The CODEC 734 may convert the digital signals to analog signals using the digital-to-analog converter 702 and may provide the analog signals to the speaker 748.

The memory 732 may include instructions 756 executable by the processor 706, the processors 710, the CODEC 734, another processing unit of the device 700, or a combination thereof, to perform methods and processes disclosed herein, such as one or more of the methods of FIGS. 5-6. One or more components of the systems of FIG. 1, 2A, 2B, or 4 may be implemented via dedicated hardware (e.g., circuitry), by a processor executing instructions to perform one or more tasks, or a combination thereof. As an example, the memory 732 or one or more components of the processor 706, the processors 710, and/or the CODEC 734 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 756) that, when executed by a computer (e.g., a processor in the CODEC 734, the processor 706, and/or the processors 710), may cause the computer to perform at least a portion of one or more of the methods of FIGS. 5-6. As an example, the memory 732 or the one or more components of the processor 706, the processors 710, the CODEC 734 may be a non-transitory computer-readable medium that includes instructions (e.g., the instructions 756) that, when executed by a computer (e.g., a processor in the CODEC 734, the processor 706, and/or the processors 710), cause the computer perform at least a portion of one or more of the methods of FIGS. 5-6.

According to one implementation, the device 700 may be included in a system-in-package or system-on-chip device 722, such as a mobile station modem (MSM). According to one implementation, the processor 706, the processors 710, the display controller 726, the memory 732, the CODEC 734, the wireless controller 740, and the transceiver 750 are included in a system-in-package or the system-on-chip device 722. According to one implementation, an input device 730, such as a touchscreen and/or keypad, and a power supply 744 are coupled to the system-on-chip device 722. Moreover, according to one implementation, as illustrated in FIG. 7, the display 728, the input device 730, the speaker 748, the microphone 746, the antenna 742, and the power supply 744 are external to the system-on-chip device 722. However, each of the display 728, the input device 730, the speaker 748, the microphone 746, the antenna 742, and the power supply 744 can be coupled to a component of the system-on-chip device 722, such as an interface or a controller. The device 700 corresponds to a mobile communication device, a smartphone, a cellular phone, a laptop computer, a computer, a tablet computer, a PDA, a display device, a television, a gaming console, a music player, a radio, a digital video player, an optical disc player, a tuner, a camera, a navigation device, a decoder system, an encoder system, or any combination thereof.

The processors 710 may be operable to perform signal encoding and decoding operations in accordance with the described techniques. For example, the microphone 746 may capture an audio signal. The ADC 704 may convert the captured audio signal from an analog waveform into a digital waveform that includes digital audio samples. The processors 710 may process the digital audio samples. The echo canceller 712 may reduce an echo that may have been created by an output of the speaker 748 entering the microphone 746.

The vocoder encoder 736 may compress digital audio samples corresponding to a processed speech signal and may form a transmit packet (e.g. a representation of the compressed bits of the digital audio samples). For example, the transmit packet may correspond to at least a portion of the bit stream 192 of FIG. 1. The transmit packet may be stored in the memory 732. The transceiver 750 may modulate some form of the transmit packet (e.g., other information may be appended to the transmit packet) and may transmit the modulated data via the antenna 742.

As a further example, the antenna 742 may receive incoming packets that include a receive packet. The receive packet may be sent by another device via a network. For example, the receive packet may correspond to at least a portion of the bit stream received at the ACELP core decoder 404 of FIG. 4. The vocoder decoder 738 may decompress and decode the receive packet to generate reconstructed audio samples (e.g., corresponding to the synthesized audio signal 473). The echo canceller 712 may remove echo from the reconstructed audio samples. The DAC 702 may convert an output of the vocoder decoder 738 from a digital waveform to an analog waveform and may provide the converted waveform to the speaker 748 for output.

In conjunction with the disclosed implementations, a first apparatus includes means for generating a first signal corresponding to a first component of a high-band portion of an input audio signal. The first component may have a first frequency range. For example, the means for generating the first signal may include the system 100 of FIG. 1, the second spectrum flipping module 242 of FIG. 2A, the filter 244 of FIG. 2A, the down-mixer 246 of FIG. 2A, the spectral flip and synthesis module 292 of FIG. 2B, the vocoder encoder 736 of FIG. 7, the processors 710 of FIG. 7, the processor 706 of FIG. 7, one or more additional processors configured to execute instructions, such as the instructions 756 of FIG. 7, or a combination thereof.

The first apparatus may also include means for generating a high-band excitation signal corresponding to a second component of the high-band portion of the audio signal. The second component may have a second frequency range that differs from the first frequency range. For example, the means for generating the high-band excitation signal may include the high-band analysis module 150 of FIG. 1, the analysis filter 202 of FIGS. 2A and 2B, the low-band encoder 204 of FIGS. 2A and 2B, the sampler 206 of FIGS. 2A and 2B, the non-linear transformation generator 208 of FIGS. 2A and 2B, the first spectrum flipping module 210 of FIGS. 2A and 2B, the filter 218 of FIGS. 2A and 2B, the adaptive whitening and scaling module 222 of FIGS. 2A and 2B, the vocoder encoder 736 of FIG. 7, the processors 710 of FIG. 7, the processor 706 of FIG. 7, one or more additional processors configured to execute instructions, such as the instructions 756 of FIG. 7, or a combination thereof.

The first apparatus may also include means for generating a synthesized version of the high-band portion of the audio signal. The means for generating the synthesized version may be configured to receive the high-band excitation signal and has filter coefficients generated based on the first signal. For example, the means for generating the synthesized version may include the high-band analysis module 150 of FIG. 1, the synthesis filter 260 of FIGS. 2A and 2B, the vocoder encoder 736 of FIG. 7, the processors 710 of FIG. 7, the processor 706 of FIG. 7, one or more additional processors configured to execute instructions, such as the instructions 756 of FIG. 7, or a combination thereof.

In conjunction with the disclosed implementations, a second apparatus may include means for generating a high-band excitation signal based on first data corresponding to a low-band portion of an audio signal. The audio signal may correspond to a received encoded audio signal that includes the first data and that further includes second data corresponding to a first component of a high-band portion of the audio signal. The first component may have a first frequency range. The high-band excitation signal may correspond to a second component of the high-band portion of the audio signal. The second component may have a second frequency range that differs from the first frequency range. The means for generating the high-band excitation signal may include the low-band encoder 404 of FIG. 4, the sampler 206 of FIG. 4, the non-linear transformation generator 208 of FIG. 4, the first spectrum flipping module 210 of FIG. 4, the filter 218 of FIG. 4, the adaptive whitening and scaling module 222 of FIG. 4, the vocoder decoder 738 of FIG. 7, the processors 710 of FIG. 7, the processor 706 of FIG. 7, one or more additional processors configured to execute instructions, such as the instructions 756 of FIG. 7, or a combination thereof.

The second apparatus may also include means for generating a synthesized version of the high-band portion of the audio signal. The means for generating the synthesized version may be configured to receive the high-band excitation signal and has filter coefficients generated based on the second data. For example, the means for generating the synthesized version may include the synthesis filter bank 470 of FIG. 4, the vocoder decoder 738 of FIG. 7, the processors 710 of FIG. 7, the processor 706 of FIG. 7, one or more additional processors configured to execute instructions, such as the instructions 756 of FIG. 7, or a combination thereof. The synthesis filter bank 470 may receive the high-band decoded signal 469. As described with respect to FIG. 4, the high-band decoded signal 469 may be generated using the second data 403 (e.g., the gain envelope data 463 and the quantized LSP indices 461). As explained with respect to FIG. 7, the decoder 400 of FIG. 4 may be included in the vocoder decoder 738 of FIG. 7. Thus, components in the vocoder decoder 738 may operate in a substantially similar manner as the synthesis filter bank 470. For example, one or more components in the vocoder decoder 738 may receive the high-band decoded signal 469 of FIG. 4 that is generated using the second data 403 (e.g., the gain envelope data 463 and the quantized LSP indices 461)

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as RAM, MRAM, STT-MRAM, flash memory, ROM, PROM, EPROM, EEPROM, registers, hard disk, a removable disk, or a CD-ROM. An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A method comprising:

receiving an audio signal at an encoder;

generating, at the encoder, a first signal corresponding to a first component of a high-band portion of the audio signal, the first component having a first frequency range;

performing, at the encoder, a transformation operation based on a low-band excitation signal to generate a high-band excitation signal corresponding to a second component of the high-band portion of the audio signal, the second component having a second frequency range mismatched relative to the first frequency range;

providing the high-band excitation signal to a filter having filter coefficients generated based on the first signal, to generate a synthesized version of the high-band portion of the audio signal for comparison with the high-band portion of the audio signal; and generating an output bit stream for transmission over a wired, wireless, or optical channel, the output bit stream based on a multiplexing operation and representative of an encoded audio signal corresponding to the audio signal.

2. The method of claim 1, wherein the first frequency range corresponds to a first frequency band spanning from a first frequency to a second frequency, and wherein the second frequency range corresponds to a second frequency band spanning from a difference between the second frequency and the first frequency to an upper frequency of the high-band portion of the audio signal.

3. The method of claim 1, wherein the first frequency range corresponds to a first frequency band spanning from approximately 6.4 kilohertz (kHz) to approximately 14.4 kHz, and wherein the second frequency range corresponds to a second frequency band spanning from approximately 8 kHz to approximately 16 kHz.

4. The method of claim 1, wherein generating the high-band excitation signal includes:

receiving, at a high-band excitation signal generation path of the encoder, the low-band excitation signal generated by a low-band encoder; and up-sampling the low-band excitation signal to generate an up-sampled signal.

5. The method of claim 4, wherein generating the high-band excitation signal further includes:

performing a non-linear transformation operation on the up-sampled signal to generate a bandwidth extended signal; and performing a spectrum flip operation on the bandwidth extended signal to generate a flipped spectrum signal.

6. The method of claim 5, wherein generating the high-band excitation signal further includes low-pass filtering the flipped spectrum signal.

7. The method of claim 1, wherein the generating of the first signal, the generating of the high-band excitation signal, and the providing of the high-band excitation signal to the filter are performed within a device that comprises a mobile device.

8. An apparatus comprising:

first circuitry in a baseband signal generation path of an encoder, the first circuitry configured to generate a first signal corresponding to a first component of a high-band portion of an audio signal, the first component having a first frequency range;

second circuitry in a high-band excitation signal generation path of the encoder, the second circuitry configured to perform a transformation operation based on a low-band excitation signal to generate a high-band excitation signal corresponding to a second component of the high-band portion of the audio signal, the second component having a second frequency range mismatched relative to the first frequency range;

a filter having filter coefficients generated based on the first signal, the filter configured to:

receive the high-band excitation signal; and generate a synthesized version of the high-band portion of the audio signal for comparison with the high-band portion of the audio signal; and an output configured to provide an output bit stream for transmission over a wired, wireless, or optical channel, the output bit stream based on a multiplexing operation and representative of an encoded audio signal corresponding to the audio signal.

9. The apparatus of claim 8, wherein the first frequency range corresponds to a first frequency band spanning from approximately 6.4 kilohertz (kHz) to approximately 14.4 kHz, and wherein the second frequency range corresponds to a second frequency band spanning from approximately 8 kHz to approximately 16 kHz.

10. The apparatus of claim 8, wherein the second circuitry is configured to:

receive the low-band excitation signal generated by a low-band encoder; and up-sample the low-band excitation signal to generate an up-sampled signal.

11. The apparatus of claim 10, wherein the second circuitry is further configured to:

perform a non-linear transformation operation on the up-sampled signal to generate a bandwidth extended signal; and perform a spectrum flip operation on the bandwidth extended signal to generate a flipped spectrum signal.

12. The apparatus of claim 11, wherein the second circuitry is further configured to perform a low-pass filter operation on the flipped spectrum signal.

13. The apparatus of claim 8, wherein the first frequency range corresponds to a first frequency band spanning from a first frequency to a second frequency, wherein the second frequency range corresponds to a second frequency band spanning from a difference between the second frequency and the first frequency to an upper frequency of the high-band portion of the audio signal, and further comprising a vocoder that includes the encoder.

14. The apparatus of claim 8, further comprising a receiver coupled to an antenna and configured to receive a signal corresponding to the audio signal, wherein the first circuitry, the second circuitry, the filter, and the receiver are integrated into a mobile device.

15. The apparatus of claim 8, wherein the first circuitry, the second circuitry, and the filter are integrated into a fixed location unit.

16. A non-transitory computer-readable medium comprising instructions that, when executed by an encoder, cause the encoder to:

generate a first signal corresponding to a first component of a high-band portion of a received audio signal, the first component having a first frequency range;

perform a transformation operation based on a low-band excitation signal to generate a high-band excitation signal corresponding to a second component of the high-band portion of the received audio signal, the second component having a second frequency range mismatched relative to the first frequency range;

provide the high-band excitation signal to a filter having filter coefficients generated based on the first signal to generate a synthesized version of the high-band portion of the received audio signal for comparison with the high-band portion of the audio signal; and provide an output bit stream for transmission over a wired, wireless, or optical channel, the output bit stream based on a multiplexing operation and representative of an encoded audio signal corresponding to the audio signal.

17. An apparatus comprising:

means for generating a first signal corresponding to a first component of a high-band portion of an audio signal, the first component having a first frequency range;

means for performing a transformation operation based on a low-band excitation signal to generate a high-band excitation signal corresponding to a second component of the high-band portion of the audio signal, the second component having a second frequency range mismatched relative to the first frequency range;

means for generating a synthesized version of the high-band portion of the audio signal for comparison with the high-band portion of the audio signal, wherein the means for performing is configured to receive the high-band excitation signal and has filter coefficients generated based on the first signal; and means for providing an output bit stream for transmission over a wired, wireless, or optical channel, the output bit stream based on a multiplexing operation and representative of an encoded audio signal corresponding to the audio signal.

18. The apparatus of claim 17, wherein the first frequency range corresponds to a first frequency band spanning from a first frequency to a second frequency, and wherein the second frequency range corresponds to a second frequency band spanning from a difference between the second frequency and the first frequency to an upper frequency of the high-band portion of the audio signal, and wherein the means for generating the first signal, the means for performing, and the means for generating the synthesized version are integrated into a mobile device.

19. The apparatus of claim 17, wherein the first frequency range corresponds to a first frequency band spanning from approximately 6.4 kilohertz (kHz) to approximately 14.4 kHz, and wherein the second frequency range corresponds to a second frequency band spanning from approximately 8 kHz to approximately 16 kHz.

20. A method comprising:

receiving an encoded version of an audio signal at a decoder, wherein the encoded version of the audio signal includes first data corresponding to a low-band portion of the audio signal and second data corresponding to a first component of a high-band portion of the audio signal, the first component having a first frequency range;

perform, at the decoder, a transformation operation based on a low-band excitation signal to generate a high-band excitation signal based on the first data, the high-band excitation signal corresponding to a second component of the high-band portion of the audio signal, the second component having a second frequency range mismatched relative to the first frequency range;

providing the high-band excitation signal to a filter having filter coefficients generated based on the second data to generate a synthesized version of the high-band portion of the audio signal; and generating a synthesized audio signal corresponding to at least one output bit stream, the at least one output bit stream generated based on a combination of a decoded version of the low-band portion of the audio signal and the synthesized version, the synthesized audio signal representative of a decoded audio signal corresponding to the audio signal.

21. The method of claim 20, wherein the first frequency range corresponds to a first frequency band spanning from approximately 6.4 kilohertz (kHz) to approximately 14.4 kHz, and wherein the second frequency range corresponds to a second frequency band spanning from approximately 8 kHz to approximately 16 kHz.

22. The method of claim 20, wherein generating the high-band excitation signal includes:

receiving, at a high-band excitation signal generation path of the decoder, the low-band excitation signal; and up-sampling the low-band excitation signal to generate an up-sampled signal.

23. The method of claim 22, wherein generating the high-band excitation signal further includes:

performing a non-linear transformation operation on the up-sampled signal to generate a bandwidth extended signal; and performing a spectrum flip operation on the bandwidth extended signal to generate a flipped spectrum signal.

24. The method of claim 23, wherein generating the high-band excitation signal further includes low-pass filtering the flipped spectrum signal.

25. The method of claim 20, wherein the first frequency range corresponds to a first frequency band spanning from a first frequency to a second frequency, and wherein the second frequency range corresponds to a second frequency band spanning from a difference between the second frequency and the first frequency to an upper frequency of the high-band portion of the audio signal.

26. A decoder comprising:

circuitry in a high-band excitation signal generation path, the circuitry configured to perform a transformation operation based on a low-band excitation signal to generate a high-band excitation signal, wherein generating the high band excitation is based on first data corresponding to a low-band portion of an audio signal, the audio signal corresponding to a received encoded audio signal that includes the first data and that further includes second data corresponding to a first component of a high-band portion of the audio signal, the first component having a first frequency range, wherein the high-band excitation signal corresponds to a second component of the high-band portion of the audio signal, the second component having a second frequency range mismatched relative to the first frequency range;

a filter configured to receive the high-band excitation signal and having filter coefficients generated based on the second data, wherein the filter is configured to generate a synthesized version of the high-band portion of the audio signal; and an output configured to provide a synthesized audio signal corresponding to at least one output bit stream, the at least one output bit stream generated based on a combination of a decoded version of the low-band portion of the audio signal and the synthesized version, the synthesized audio signal representative of a decoded audio signal corresponding to the audio signal.

27. The decoder of claim 26, wherein the first frequency range corresponds to a first frequency band spanning from approximately 6.4 kilohertz (kHz) to approximately 14.4 kHz, and wherein the second frequency range corresponds to a second frequency band spanning from approximately 8 kHz to approximately 16 kHz.

28. The decoder of claim 26, wherein the circuitry is configured to:

receive the low-band excitation signal; and up-sample the low-band excitation signal to generate an up-sampled signal.

29. The decoder of claim 28, wherein the circuitry is further configured to:

perform a non-linear transformation operation on the up-sampled signal to generate a bandwidth extended signal; and perform a spectrum flip operation on the bandwidth extended signal to generate a flipped spectrum signal.

30. The decoder of claim 29, wherein the circuitry is further configured to perform a low-pass filter operation on the flipped spectrum signal.

31. The decoder of claim 26, wherein the first frequency range corresponds to a first frequency band spanning from a first frequency to a second frequency, and wherein the second frequency range corresponds to a second frequency band spanning from a difference between the second frequency and the first frequency to an upper frequency of the high-band portion of the audio signal.

32. An apparatus comprising:

means for performing a transformation operation based on a low-band excitation signal to generate a high-band excitation signal, wherein generating the high band excitation is based on first data corresponding to a low-band portion of an audio signal, the audio signal corresponding to a received encoded audio signal that includes the first data and that further includes second data corresponding to a first component of a high-band portion of the audio signal, the means for performing configured to perform a resampling process that includes low-pass filtering a flipped spectrum signal, the first component having a first frequency range, wherein the high-band excitation signal corresponds to a second component of the high-band portion of the audio signal, the second component having a second frequency range mismatched relative to the first frequency range;

means for generating a synthesized version of the high-band portion of the audio signal, wherein the means for generating the synthesized version is configured to receive the high-band excitation signal and has filter coefficients generated based on the second data; and means for providing a synthesized audio signal corresponding to at least one output bit stream, the at least one output bit stream generated based on a combination of a decoded version of the low-band portion of the audio signal and the synthesized version, the synthesized audio signal representative of a decoded audio signal corresponding to the audio signal.

33. The apparatus of claim 32, wherein the first frequency range corresponds to a first frequency band spanning from approximately 6.4 kilohertz (kHz) to approximately 14.4 kHz, and wherein the second frequency range corresponds to a second frequency band spanning from approximately 8 kHz to approximately 16 kHz.

34. The apparatus of claim 32, wherein the first frequency range corresponds to a first frequency band spanning from a first frequency to a second frequency, and wherein the second frequency range corresponds to a second frequency band spanning from a difference between the second frequency and the first frequency to an upper frequency of the high-band portion of the audio signal.

35. A non-transitory computer-readable medium comprising instructions that, when executed by a processor within a decoder, cause the processor to:

receive an encoded version of an audio signal, wherein the encoded version includes first data corresponding to a low-band portion of the audio signal and second data corresponding to a first component of a high-band portion of the audio signal, the first component having a first frequency range;

perform a transformation operation based on a low-band excitation signal to generate a high-band excitation signal, wherein generating the high band excitation is based on the first data, the high-band excitation signal corresponding to a second component of the same high-band portion of the audio signal, wherein the second component has a second frequency range mismatched relative to the first frequency range;

provide the high-band excitation signal to a filter having filter coefficients generated based on the second data to generate a synthesized version of the high-band portion of the audio signal; and provide a synthesized audio signal corresponding to at least one output bit stream, the at least one output bit stream generated based on a combination of a decoded version of the low-band portion of the audio signal and the synthesized version, the synthesized audio signal representative of a decoded audio signal corresponding to the audio signal.

36. The non-transitory computer-readable medium of claim 35, wherein the first frequency range corresponds to a first frequency band spanning from approximately 6.4 kilohertz (kHz) to approximately 14.4 kHz, and wherein the second frequency range corresponds to a second frequency band spanning from approximately 8 kHz to approximately 16 kHz.

* * * * *